US008088141B1

(12) United States Patent
Reyna

(10) Patent No.: US 8,088,141 B1
(45) Date of Patent: Jan. 3, 2012

(54) APPARATUS FOR PREVENTING AND REMOVING FOREHEAD WRINKLES

(76) Inventor: Ralph L. Reyna, Fairfield, CA (US)

( * ) Notice: Subject to any disclaimer, the term of this patent is extended or adjusted under 35 U.S.C. 154(b) by 292 days.

(21) Appl. No.: 12/386,334

(22) Filed: Apr. 16, 2009

Related U.S. Application Data

(63) Continuation-in-part of application No. 12/005,327, filed on Dec. 26, 2007, now abandoned.

(51) Int. Cl.
*A61F 5/08* (2006.01)

(52) U.S. Cl. ..... 606/204.35; 601/134; 602/74

(58) Field of Classification Search ..... 606/201, 606/202, 204.35, 204.15; 602/74; 128/848, 128/898; 132/53, 200; 601/134
See application file for complete search history.

(56) References Cited

U.S. PATENT DOCUMENTS

| | | | | |
|---|---|---|---|---|
| 1,062,600 | A | | 5/1913 | McDonald |
| 1,453,926 | A | | 5/1923 | Eager |
| 1,550,595 | A | | 8/1925 | Taylor |
| 1,900,002 | A | | 3/1933 | Varell |
| 3,459,186 | A | * | 8/1969 | Schwartz ..... 604/370 |
| 3,540,440 | A | | 11/1970 | Andreas |
| 3,672,362 | A | | 6/1972 | Basche |
| 4,521,922 | A | | 6/1985 | Mitchell et al. |
| 4,646,728 | A | | 3/1987 | Takeda |
| 4,656,671 | A | | 4/1987 | Manges |
| 4,944,289 | A | * | 7/1990 | Matthews ..... 601/134 |
| 4,991,573 | A | * | 2/1991 | Miller ..... 602/19 |
| 5,555,900 | A | | 9/1996 | Rich |
| 5,903,921 | A | | 5/1999 | Dow |
| 6,427,253 | B1 | | 8/2002 | Penny |
| 6,554,787 | B1 | * | 4/2003 | Griffin et al. ..... 602/74 |

* cited by examiner

*Primary Examiner* — Tuan Nguyen
(74) *Attorney, Agent, or Firm* — Thomas R. Lampe

(57) ABSTRACT

Apparatus for preventing and removing forehead wrinkles includes an elongated member having an elastic memory, a cover member releasably connected to the elongated member and covering a central portion thereof, and one or more pad-like pressure members sandwiched between the central portion to apply enhanced localized pressure to the forehead of a wearer.

12 Claims, 2 Drawing Sheets

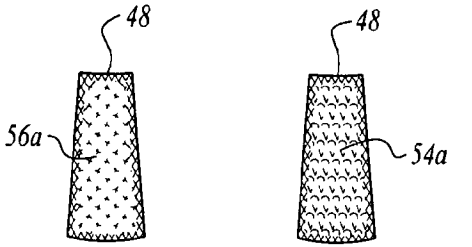
Fig. 7
Fig. 8
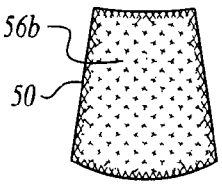
Fig. 9
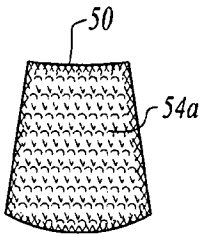
Fig. 10
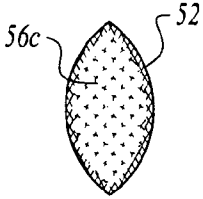
Fig. 11
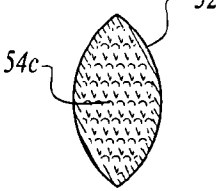
Fig. 12
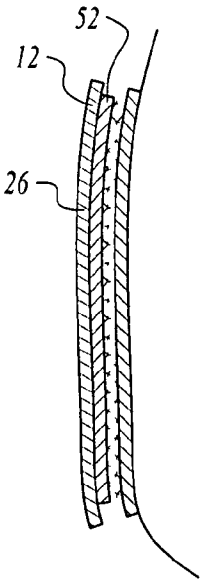
Fig. 13
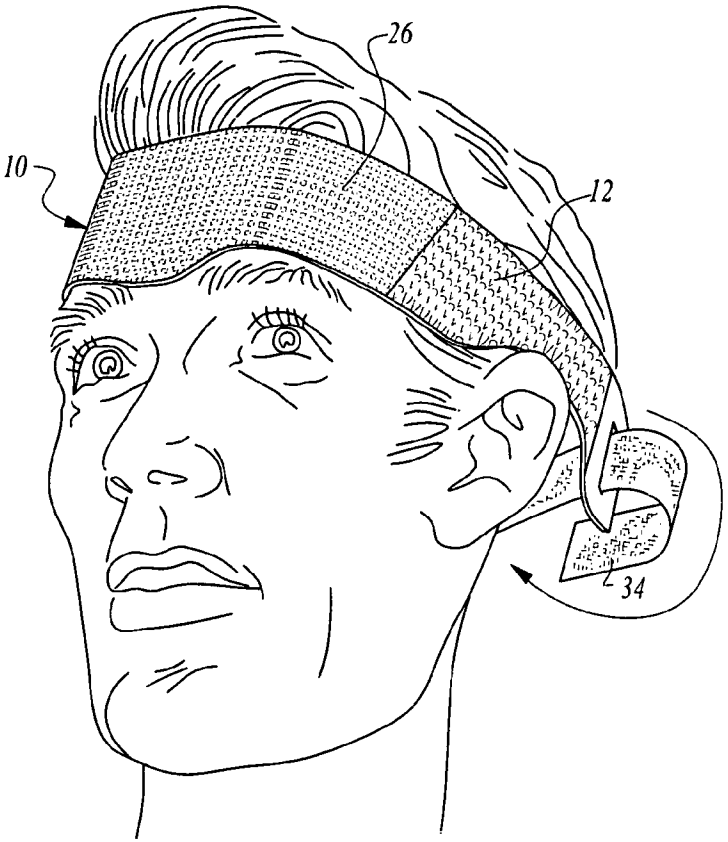
Fig. 1

46
40
46
16
26
43
43
12
14
34

38
36
16
32
24
20
30
31
26
22
31
12
32
14
34

34
14
24
12
22
28
18
16

31
40
31
42

46
40
46

APPARATUS FOR PREVENTING AND REMOVING FOREHEAD WRINKLES

This application is a Continuation-in-Part of U.S. patent application Ser. No. 12/005,327, filed Dec. 26, 2007 now abandoned.

TECHNICAL FIELD

This invention relates to an apparatus worn by an individual for the purpose of preventing and removing forehead wrinkles, including wrinkles formed along vertical lines. The invention is particularly useful for overnight wear to prevent formation of bed wrinkles.

BACKGROUND OF THE INVENTION

A number of devices have been devised over the years in an attempt to remove or diminish wrinkles in an individual's face, in some cases the forehead of the face. In addition, numerous so-called anti-wrinkle creams and ointments are on the market and have been for a great many years.

Headbands of various types for covering a user's forehead are of course well known, but such devices are ineffective to prevent formation of wrinkles or removal or diminishment of wrinkles.

The following United States patents disclose devices which are believed to be representative of the current state of the prior art in this field: U.S. Pat. No. 1,550,595, issued Aug. 18, 1925, U.S. Pat. No. 5,903,921, issued May 18, 1999, U.S. Pat. No. 1,453,926, issued May 1, 1923, U.S. Pat. No. 1,900,002, issued Mar. 7, 1933, U.S. Pat. No. 3,540,440, issued Nov. 17, 1970, U.S. Pat. No. 4,521,922, issued Jun. 11, 1985, U.S. Pat. No. 4,646,728, issued Mar. 3, 1987, U.S. Pat. No. 6,427,253, issued Aug. 6, 2002, U.S. Pat. No. 4,656,671, issued Apr. 14, 1987, U.S. Pat. No. 3,672,362, issued Jun. 27, 1972 and U.S. Pat. No. 1,062,600, issued May 27, 1913 and U.S. Pat. No. 5,555,900 issued Sep. 17, 1996.

The present invention is operable to prevent wrinkling and smooth out, diminish, and in some cases remove entirely both vertical and non vertical lines in the vicinity of an individual's forehead. None of the devices described in the above-referenced patents have this capability. Furthermore, such devices are typically uncomfortable to wear over an extended period of time. The present invention is comfortable and readily lends itself to use while an individual is in bed to prevent formation of wrinkles.

DISCLOSURE OF INVENTION

This invention relates to apparatus for removing forehead wrinkles which is highly effective and is comfortable when worn by an individual even while sleeping.

The apparatus includes an elongated member of flexible material. The elongated member has opposed ends, inner and outer elongated member surfaces, a top edge, a bottom edge, and a central portion having inner and outer central portion surfaces.

Securement structure is provided for securing the elongated member to the head of an individual with the central portion located at the individual's forehead.

The apparatus also includes a cover member having an outer cover member surface releasably attached to the elongated member adjacent to the inner central portion surface and covering said inner central portion surface. The cover member has a forehead engagement surface opposed to the outer cover member surface.

At least one pad-like pressure member is sandwiched between the cover member and the central portion for applying a compressive force to the individual's forehead when the securement structure secures the elongated member to the individual's head.

Other features, advantages and objects of the present invention will become apparent with reference to the following description and accompanying drawings.

BRIEF DESCRIPTION OF DRAWINGS

FIG. 1 is a front, perspective view showing apparatus constructed in accordance with the teachings of the present invention being secured in place on the head of an individual;

FIGS. 7 and 8 are elevational views of a first embodiment of a pad-like pressure member utilized in the apparatus and showing respectively the front and back sides thereof;

FIGS. 9 and 10 are views similar to FIGS. 7 and 8, illustrating a second embodiment of a pad-like pressure member;

FIGS. 11 and 12 are views similar to FIGS. 7-8 and 9-10, but illustrating a third embodiment of a pad-like pressure member; and FIG. 13 is an enlarged, cross-sectional view of the apparatus bearing against a forehead and illustrating the elongated member, the cover member and a pad-like pressure member sandwiched therebetween positioned in place on the forehead of an individual.

BEST MODE FOR CARRYING OUT THE INVENTION

Figures 2, 3, 4, 5, 6:
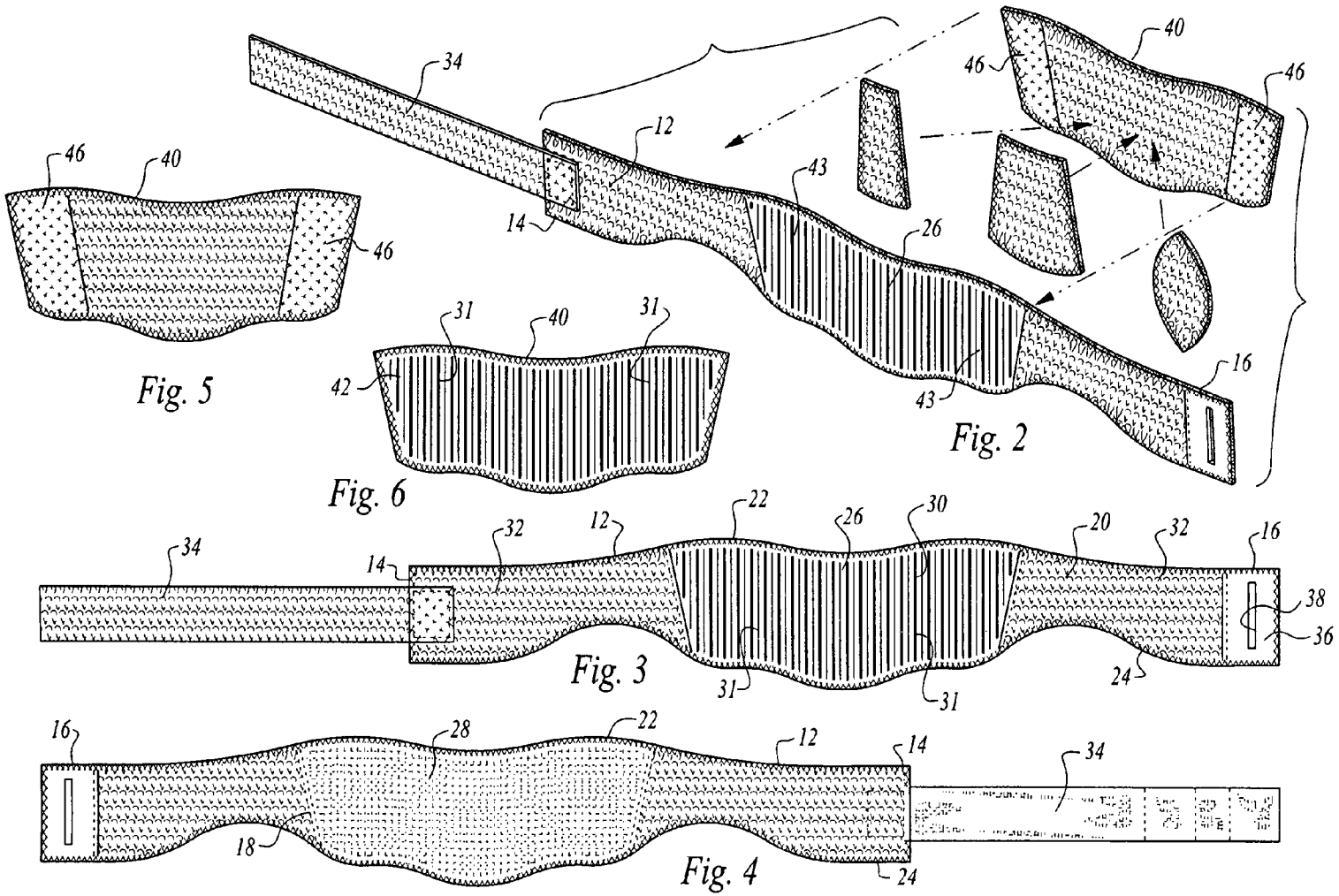
FIG. 2 is a front, perspective, exploded view illustrating structural components of the apparatus.
FIG. 3 is a front, elevational view illustrating an elongated member and securement structure of the apparatus when removed from an individual's head and in a flat condition.
FIG. 4 is a rear, elevational view of the elongated member and securement structure flipped end over end from the position illustrated in FIG. 3 and in a flat condition.
FIG. 5 is an elevational view of the cover member of the invention and illustrating the front or outer cover member surface thereof.
FIG. 6 is an elevational view of the cover member and illustrating the back or forehead engagement surface thereof.

Referring now to the drawings, apparatus constructed in accordance with the teachings of the present invention is designated by reference numeral 10 in FIG. 1, the apparatus being applied to the head of an individual. The apparatus is very comfortable once in place and may be worn even while sleeping to prevent formation of bed wrinkles.

Apparatus 10 includes an elongated member 12 of flexible material. Any suitable flexible material may be utilized, an exemplary material being a nylon/Lycra blend fabric. The fabric is preferably perforated. The elongated member 12 has opposed ends 14, 16, inner and outer elongated member surfaces 18, 20, a top edge 22, a bottom edge 24 and a central portion 26. The central portion has an inner central portion surface 28 and an outer central portion surface 30.

In the arrangement illustrated, the outer central portion surface comprises a layer of corduroy-like cotton or other cloth having generally vertically oriented, spaced ribs 31. The layer is stitched to the rest of the elongated member by overlock stitching extending about the entire periphery of the elongated member, such stitching also being utilized to secure fabric and components of synthetic hook and loop material to the elongated member as described below. Stitching is also utilized to secure the ends of the layer in place.

Between the central portion and the ends 14, 16, the elongated member 12 on the front thereof is covered by a loop component 32 of synthetic hook and loop fastener material.

Again with reference to the front of the elongated member as shown in FIGS. 2 and 3, a strap 34 is stitched or otherwise secured to end 14, the strap also being covered by a loop component of synthetic hook and loop fastener material. At the proximal end thereof the strap is covered by the hook component of such material.

Located at end 16 of the elongated member is a connector 36 of leather or other suitable material stitched in place at the end 16 and defining a slot 38 through which the strap 34 is passed (as shown in FIG. 1) when securing the apparatus to the head of an individual. Engagement between the loop fastener material component of the strap with the hook component located at end 14 will releasably secure the elongated member in place on the individual's head.

Referring now to FIG. 4, the portions of the elongated member between the central portion and the ends 14, 16 are covered by a loop component of synthetic hook and loop fastener material stitched or otherwise secured in place.

Another structural component of the apparatus is cover member 40 which, in the arrangement illustrated, has the same general configuration as, but is longer than, the central portion 26 of the elongated member 12. The cover member has an outer or front cover member surface 32 releasably attachable to the elongated member adjacent to the ends of the inner central portion surface 28. This is accomplished by employing hook components of synthetic hook and loop fastener material at the end portions 46 of the cover member at the outer cover member surface, as illustrated in FIGS. 2 and 5. Between these end segments the outer cover member surface is a layer of synthetic fastener loop component material.

As shown in FIG. 6, the cover member has a forehead engagement surface 42 opposed to the outer cover member surface. The surface 42 has a plurality of outwardly projecting ribs 31 thereon, the layer forming the surface suitably being corduroy-like cloth, such as cotton.

Another important aspect of the present invention is the use of one or more pad-like pressure members sandwiched between the cover member and the central portion while applying a compressive force to the individual's forehead when the securement structure secures the elongated member to an individual's head.

FIG. 2 and FIGS. 7-12 illustrate three different representative embodiments of pressure members which may be utilized. The different pad-like pressure members are identified by reference numerals 48, 50 and 52. Pressure members 48, 50, 52 are for the purpose of being sandwiched between the cover member and the central portion to provide a more concentrated compressive force to the individual's forehead at the locations of the pressure members than the area surrounding the pressure members.

The pressure members have front sides (identified by reference numerals 54*a*, 54*b* and 54*c*) and back sides (identified by reference numerals 56*a* 56*b* and 56*c*). The front sides are covered by the loop component of synthetic hook and loop fastener material while the back sides 56 are covered by the hook component of synthetic hook and loop fastener material. This allows the pressure member or members to be releasably connected by the synthetic hook and loop fastener material to the outer cover member surface 42 of cover member 40.

One or more pressure members may be installed as desired to provide the desired pressure effect and the pressure member or pressure members may be readily removed and repositioned at desired locations. Furthermore, pressure members can be stacked and secured together by the synthetic hook and loop fastener material to provide pressure of greater magnitude. When the cover member is attached to the elongated member by the end portions or segments 46, the pressure member or members on the cover member will be sandwiched between the cover member and the central portion. FIG. 13 is a cross-sectional view illustrating a single pressure member 52 sandwiched in place between the cover member and the central portion 26.

It will be appreciated that the shapes and sizes of the pressure members can be varied from those illustrated. In alternative arrangements, the pressure members could be releasably attached to the central portion 26 by synthetic hook and loop fastener material or the pressure members could be attached by such fastener material to both the cover member and the central portion.

The pressure members result in enhanced localized pressure being applied at selected locations on a wearer's forehead when the elongated member is tensioned. The wearer can use one or more of the pressure members at a time and can readily adjust placement as desired.

The ribs 31 provide a skin smoothing effect when the apparatus is worn while at the same time providing a high degree of wearer comfort. If desired, the cover member and pressure members can be removed and the elongated member flipped over and employed separately on a wearer's head, the corduroy-like cloth on the elongated member engaging the forehead.

The invention claimed is:

1. Apparatus for preventing and removing forehead wrinkles, said apparatus comprising in combination:

an elongated member of flexible material, said elongated member having opposed ends, inner and outer elongated member surfaces, a top edge, a bottom edge, and a central portion between said top and bottom edges having inner and outer central portion surfaces;

securement structure for securing the elongated member to the head of an individual with the central portion located at the individual's forehead;

a cover member having an outer cover member surface releasably attached to the elongated member adjacent to said inner central portion surface covering said inner central portion surface, said cover member having a forehead engagement surface opposed to said outer cover member surface;

at least one pad-like pressure member sandwiched between said cover member and said central portion for applying a compressive force to the individual's forehead when said securement structure secures the elongated member to the individual's head, said at least one pad-like pressure member releasably connected to at least one of said cover member and said central portion to allow repositioning and removal of said at least one pad-like pressure member relative to said cover member and said central portion;

and wherein said at least one pad-like pressure member has front and back sides, components of hook and loop fastener material being attached to at least one of the front and back sides of said at least one pad-like pressure member and attached to at least one of said outer cover member surface and said inner central portion surface.

2. The apparatus according to claim 1 wherein the front and back sides of said at least one pad-like pressure member have an area smaller than the area of said cover member outer surface and the area of said central portion inner surface and the cover member and the central portion are releasably connected together adjacent to said at least one pad-like pressure member.

3. The apparatus according to claim 1 wherein a plurality of pad-like pressure members are sandwiched between said cover member and said central portion for applying compressive forces at different locations on the individual's forehead when said securement structure secures the elongated member to the individual's head.

4. The apparatus according to claim 3 wherein at least some of said plurality of pad-like pressure members are of different sizes or configurations.

5. The apparatus according to claim 1 wherein said outer central portion surface is a cloth surface having a plurality of rib-like projections, said elongated member being selectively reversible to direct either said outer central portion surface or said inner central portion surface toward the individual's forehead.

6. The apparatus according to claim 1 wherein said bottom edge forms a curved projection at said central portion.

7. The apparatus according to claim 1 wherein said securement structure includes an adjustable securement strap.

8. The apparatus according to claim 1 wherein said elongated member has overlock stitching about the outer peripheral edge thereof.

9. The apparatus according to claim 1 wherein perforated fabric forms the inner central portion surface.

10. The apparatus according to claim 1 wherein the forehead engagement surface of said cover is a cloth surface having a plurality of rib-like projections.

11. The apparatus according to claim 1 wherein different components of said hook and loop fastener material are attached to opposite sides of said at least one pad-like pressure member.

12. Apparatus for preventing and removing forehead wrinkles, said apparatus comprising in combination:

an elongated member of flexible material, said elongated member having opposed ends, inner and outer elongated member surfaces, a top edge, a bottom edge, and a central portion between said top and bottom edges having inner and outer central portion surfaces;

securement structure for securing the elongated member to the head of an individual with the central portion located at the individual's forehead;

a cover member having an outer cover member surface releasably attached to the elongated member adjacent to said inner central portion surface covering said inner central portion surface, said cover member having a forehead engagement surface opposed to said outer cover member surface; and at least one pad-like pressure member sandwiched between said cover member and said central portion for applying a compressive force to the individual's forehead when said securement structure secures the elongated member to the individual's head, said cover member being longer than said central portion and extending beyond the ends of said central portion, said inner elongated member surface covered with a component of synthetic hook and loop connector material adjacent to said central portion and said outer cover member surface having ends covered with a component of synthetic hook and loop material engageable with the synthetic hook and loop connector material on said inner elongated member surface.

* * * * *